United States Patent [19]

Rose

[11] 4,102,112

[45] Jul. 25, 1978

[54] PACKAGING MACHINE

[75] Inventor: Henry B. Rose, Worchester, Mass.

[73] Assignee: Curtis & Marble Corporation, Worcester, Mass.

[21] Appl. No.: 638,467

[22] Filed: Dec. 8, 1975

[51] Int. Cl.[2] ..... B65B 11/08

[52] U.S. Cl. ..... 53/228; 53/230

[58] Field of Search ..... 53/228, 229, 182 R, 53/184 S

[56] References Cited

U.S. PATENT DOCUMENTS

| | | | |
|---|---|---|---|
| 2,893,191 | 7/1959 | Lancaster | 53/214 X |
| 3,564,810 | 2/1971 | Faletti et al. | 53/182 R X |
| 3,643,397 | 2/1972 | Bahnsen | 53/182 R X |
| 3,766,708 | 10/1973 | Kubo et al. | 53/184 S X |

*Primary Examiner*—Othell M. Simpson
*Assistant Examiner*—John Sipos
*Attorney, Agent, or Firm*—Norman S. Blodgett; Gerry A. Blodgett

[57] ABSTRACT

Packaging machine for elongated articles, wherein a frame is provided having an opening through which the article is laterally moved, wherein a roller of wrapping material is mounted at the top of the frame so that the material hangs as a curtain across the opening, and wherein sealing means is provided for sealing the material around the article when the article is pushed laterally into the curtain.

5 Claims, 9 Drawing Figures

PACKAGING MACHINE

BACKGROUND OF THE INVENTION

It has become common practice to wrap elongated articles, such as rolls of floor carpet, in a film of thermoplastic and to heat-seal the wrapping around the article. A water-impervious jacket is thus provided around the article and this is very desirable. An example of an apparatus for performing this packaging function is shown in the patent of Davidson et al. U.S. Pat. No. 3,518,806 which issued July 7, 1970; in this prior art apparatus two rolls of thermoplastic film are mounted in a frame in spaced parallel relationship and the ends of the film are heat-sealed together. The joint is laid along the roll of carpet and the strips from the two rolls are wrapped around in opposite directions until they meet on the opposite side of the roll of carpet. At that point they are heat-sealed to form another sealed joint. The prior art apparatus of this type is complex and expensive and it is very difficult to manipulate heavy articles through the wrapping cycle. When the material emerges from two rolls in the manner described above, the envelope around the wrapped article has two longitudinal seams, which means that the probability of an opening into the envelope occurring is doubled and the appearance of the envelope is somehwat less desirable. Furthermore, if a number of articles of differing lengths are wrapped in this apparatus, the width of plastic film that is used must be selected for the longest article, so that when short articles are wrapped, there is a substantial waste of plastic film. These and other difficulties experienced with the prior art devices have been obviated in a novel manner by the present invention.

An object of this invention is the provision of a packaging machine for elongated articles in which articles of substantially different lengths can be wrapped in the machine without changing rolls of wrapping material and without wasting wrapping material when short length articles are wrapped.

A further object of the present invention is the provision of a packaging machine making use of a plurality of rolls of relatively narrow width thermoplastic film, wherein sub-multiples of these strips can be used to approximate the length of a particular article to be wrapped.

It is another object of the instant invention to provide a packaging machine providing a curtain of multiple strips slightly overlapped and adapted to be heat-sealed when wrapped around an elongated article, means being provided to assure that a given strip is not pulled down from its roll when it is not to be used in wrapping a particular article.

A still further object of the invention is the provision of a packaging machine for wrapping and sealing elongated articles with thermoplastic film, wherein the joint resulting from one wrapping cycle does not appear in the wrapping cycle which immediately follows.

It is a further object of the invention to provide a machine for wrapping an elongated article in a thermoplatic film, wherein the wrapper is made up of a multitude of narrow strips arranged in side-by-side relationship, the article and wrapping being subjected to a heat-shrinking operation after the wrapping is completed.

It is a still further object of the present invention to provide a packaging machine for elongated articles, which machine is rugged in construction, which is inexpensive to manufacture, which can be operated by unskilled labor, or be built in full-automatic version, and which is capable of a long life of useful service with a minimum of maintanance.

It is another object of the invention to provide a packaging machine which can wrap objects longer than the width of the widest plastic films commercially available, through the device of a segmented film curtain made up of segments of film of width which are commercially available.

With these and other objects in view, as will be apparent to those skilled in the art, the invention resides in the combination of parts set forth in the specification and covered by the claims appended hereto.

SUMMARY OF THE INVENTION

In general, the invention consists of a packaging machine for elongated articles, the machine having a frame with an opening through which the article can be passed laterally from an input side to an output side and having means supporting a plurality of rolls of wrapping material on the frame above the opening, so that strips of material can pass downwardly through the opening in side-by-side relationship with a slight overlap between adjacent strips. Means is mounted on the frame extending across the opening to form a joint between two portions of the bight of each strip to each other after the article has passed through the opening. A take-up means is provided to pull these strips downwardly a pre-determined amount after the joint has been formed.

More specifically, the take-up means holds the lower portions of the strips, so that the passage of the article through the opening causes it to engage the bight of the strips and to pull the strips downwardly only from the rolls. Means to form the joint consist of two opposed sealing bars, one or both of which is equipped with heating elements and the passage of the article through the opening causes the strips to wrap partially around the article, while the movement of the bar substantially completes the wrapping.

A heating tunnel is provided at the output side of the machine, the wrapping material being a film of heat-shrinkable plastic and a conveyor being provided to pass the article and the wrapping material into the tunnel for a heat-shrinking operation.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
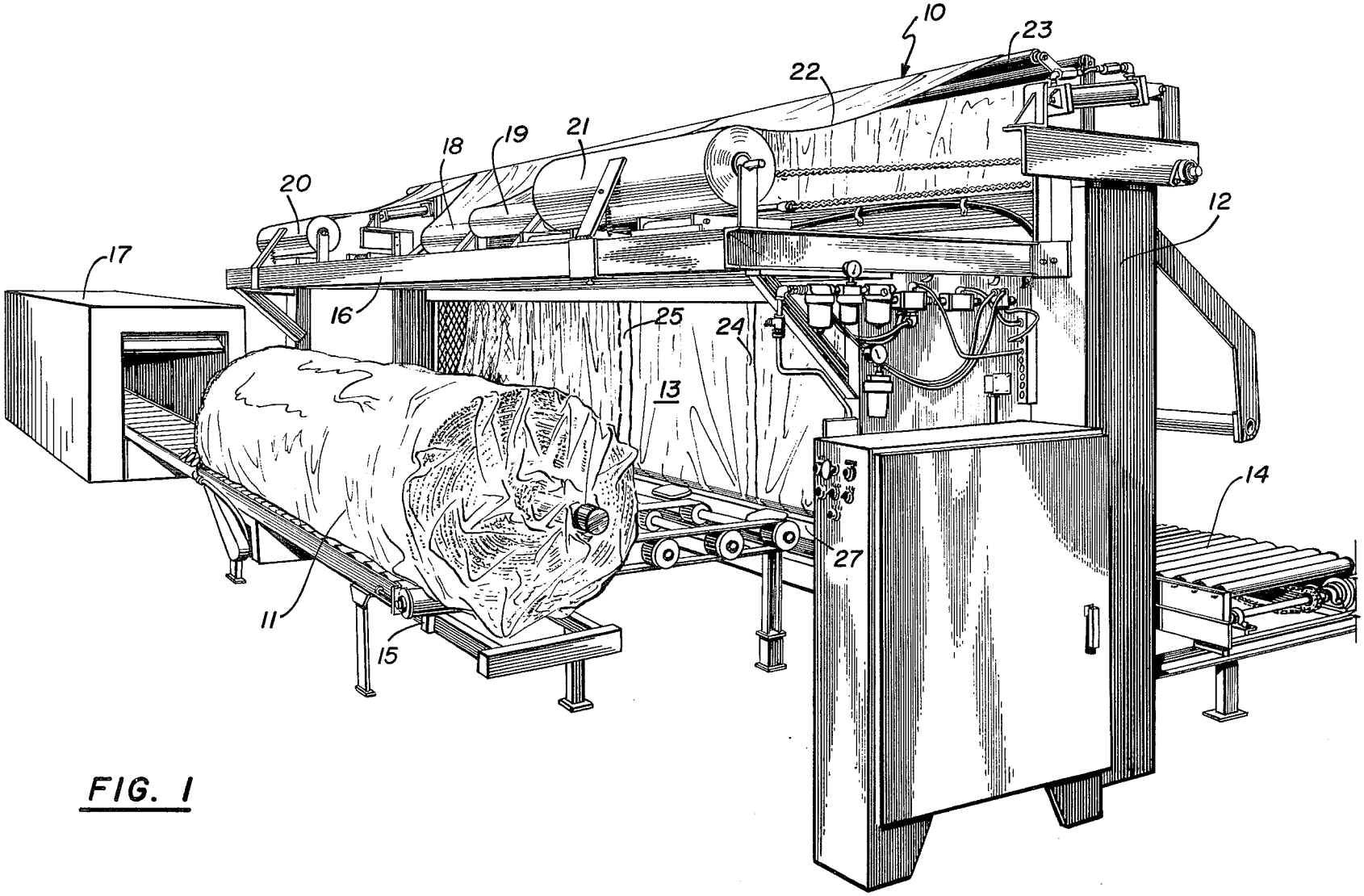
FIG. 1 is a perspective view of a packaging machine embodying the principles of the present invention as observed from the output side.
Figure 2:
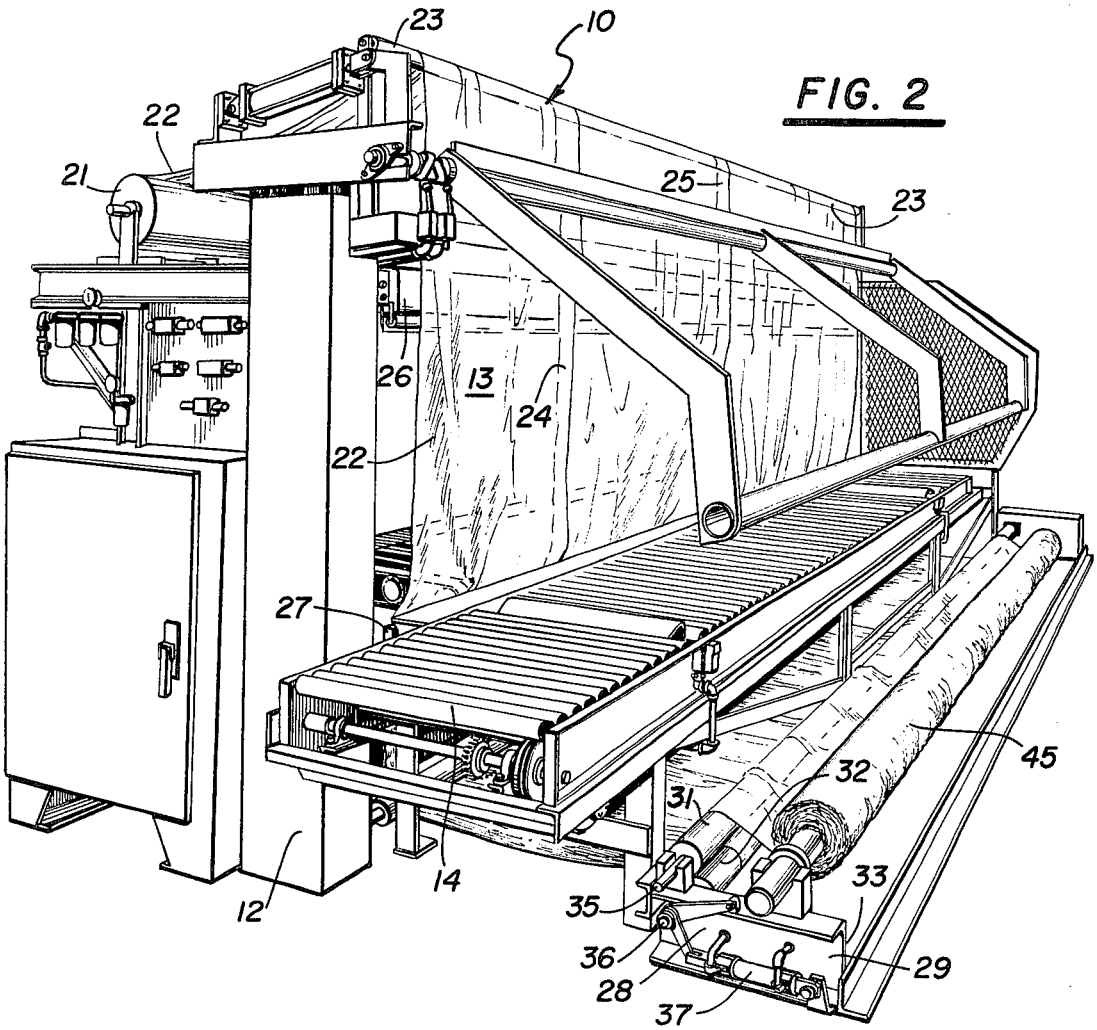
FIG. 2 is a perspective view of a packaging machine as observed from the input side.

Referring first to FIGS. 1 and 2, wherein are best shown the general features of the invention, the packaging machine, indicated generally by the reference numeral 10, is shown in use with an elongated article 11, such as a coil of carpet. The machine is provided with a frame 12 which extends generally vertically from the floor of the mill, is provided with vertical uprights and a crosspiece to define a vertical rectangular opening 13, through which the article 11 can pass laterally from a conveyor 14 on the input side to a conveyor 15 on the output side, the conveyor 15 leading to a shrink-tunnel 17.

As is evident in FIG. 1, extending from the upper part of the frame 12, is a shelf-like support means 16 provided with suitable horizontal rods for supporting a plurality of rolls 18, 19, 20 and 21. Each of these rolls consists of a coil of wrapping material 22, which in the preferred embodiment consists of a film of thermoplastic of the heat-shrinkable type. The strips of wrapping material extend from their respective rolls and pass over any elongated roller 23 and pass downwardly through the opening 13 in side-by-side relationship with a slight overlap between adjacent strips. Since the illustration shows four rolls 18, 19, 20, and 21, there are four strips hanging over the opening to form a curtain and the overlaps are indicated by the reference numerals 24 and 25. Mounted on the frame and extending across the opening 13 is a heat-sealing means including horizontal heating bars 26 and 27, one or both of which is slidable vertically in the conventional way to squeeze and heat layers of thermoplastic between them to produce a seal. This seal is produced on the intermediate portion of the strips of wrapping material after the article 11 has passed through the opening 13 and through the plane of action of the heating bars.

Associated with the frame 12 and extending beside the input conveyor 14 is a take-up mechanism 28, adapted to pull the strips of wrapping materials onwardly a predetermined amount after the joint has been formed by the heating bars 26 and 27. The take-up mechanism holds the lower portions of the strips, so that the passage of the article 11 through the opening 13 causes the article to engage the bight of the strips and to pull the strips downwardly only from one or more of the rolls 18, 19, 20, and 21, depending on the length of article 11. It should be noted that the passage of the article 11 through the opening 13 causes the strips of wrapping material to wrap partially around the article, while the movement of the heating elements 26 and 27 substantially completes the wrapping.

Figure 3:
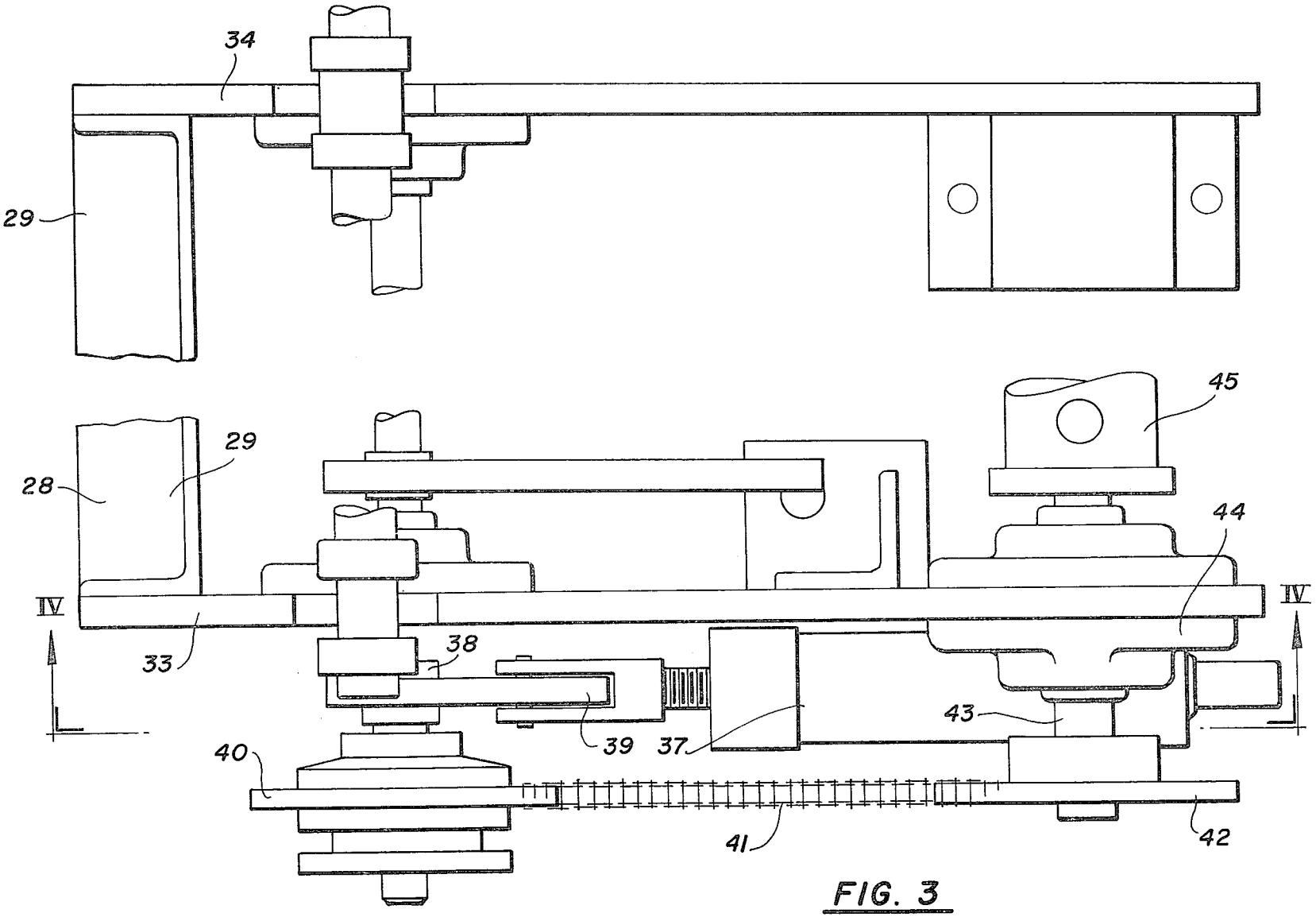
FIG. 3 is an enlarged plan view of a take-up mechanism forming part of the invention.
Figure 4:
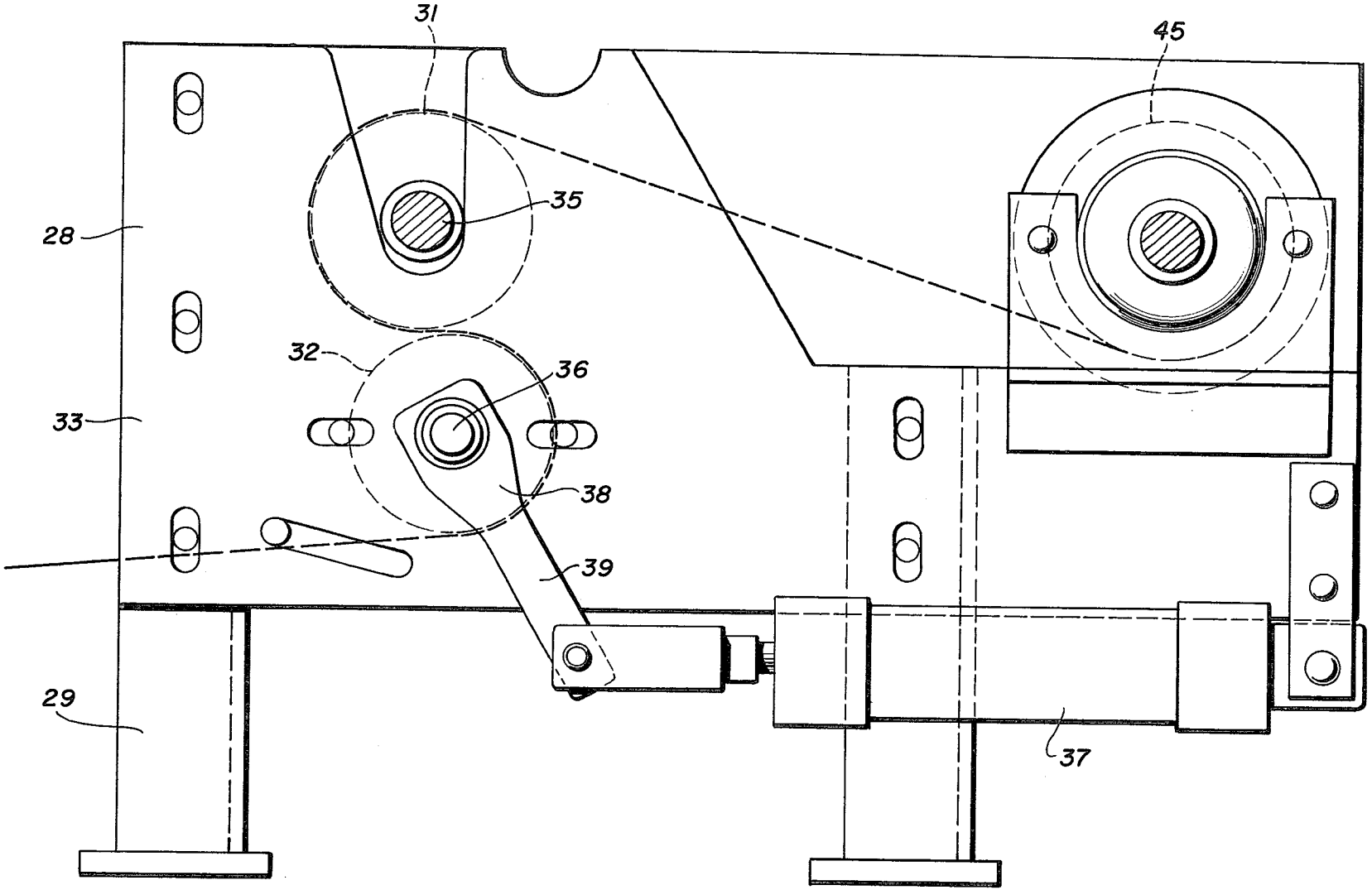
FIG. 4 is a vertical sectional view of the take-up mechanism taken on the line IV—IV of FIG. 3, FIGS. 5, 6 and 7 are schematic views of the machine showing its condition at different parts of a wrapping cycle.

The details of the take-up mechanism 28 are shown in FIGS. 2, 3, and 4. A pair of pinch rolls 31 and 32 are rotatably mounted on a frame 29. The frame is provided with end plates 33 and 34 which are fitted with suitable bearings to support the axles 35 and 36 associated with the pinch rolls 31 and 32 respectively. A cylinder 37 is mounted on the end plate 33 of the frame and is suitably provided with pneumatic hoses connected back to a valve which is actuated at a certain part of the cycle to energize the cylinder. Mounted on the axle 36 of the roll 32 is a ratchet mechanism 38 having an actuating handle 39. The top pinch roll is an idle roll, but the operation of the ratchet 38 whose handle is pivotally attached to the outer end of the piston rod of the cylinder 37, not only operates to rotate the axle 36 of the pinch role 32, but also the axle on its outboard end carries a sprocket wheel 40 which is connected by the usual sprocket chain 41 to a sprocket wheel 42 mounted on an axle 43. This axle operates through an over-running clutch 44 to operate a take-up roll 45. The sprocket wheels and over-running clutch have been removed from FIG. 2 in order to clarify the presentation of the other parts. The ratchet mechanism 38 is of the type manufactured by the Lowell Corporation of Worcester, Mass. and designated as their Series 115 ratchet arm.

Figure 5:
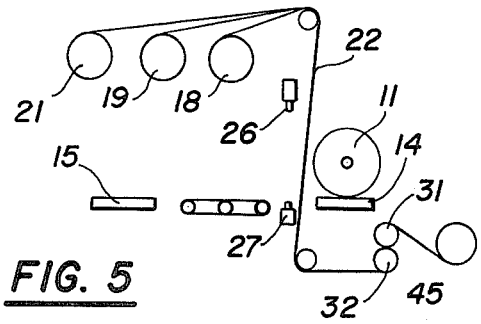
Figure 6:
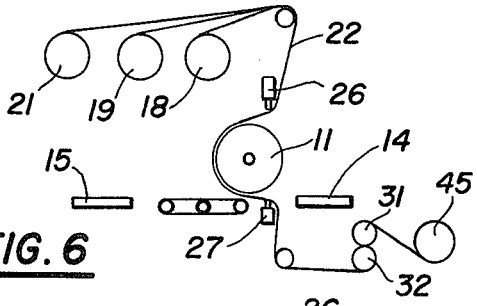
Figure 7:
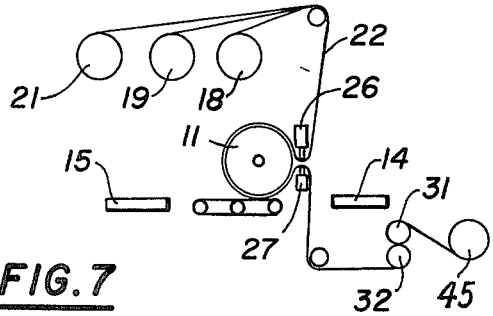

The operation of the packaging machine 10 will now be readily understood in view of the above description. The elongated article 11 is introduced to the machine on the conveyor 14, as shown in FIG. 5. At that time, the heating bars 26 and 27 are widely separated. As shown in FIG. 6, the article 11 is pushed into the bight of the wrapping material strips 22 and passes through the opening in the frame. This causes the material to be wrapped approximately half way around the article. As shown in FIG. 7, the heating bar 26 is moved downwardly and two layers of the material are pressed between it and bar 27. The heating bars are constructed so that they heat both sides of a severed part so that the article 11 proceeds to the conveyor 15 and eventually into the shrinking tunnels 17 with a single longitudinal seam. The remainder of the material also has its own seam and soon after the sealing operation takes place, the take-up mechanism 28 pulls the material downwardly a short distance.

Figure 8:
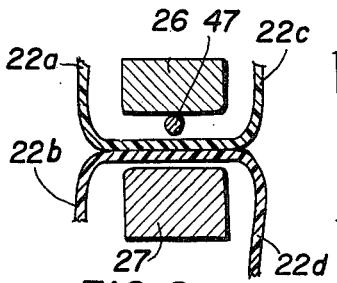
FIG. 8 is a sectional view of a portion of a machine during the sealing operation.
Figure 9:
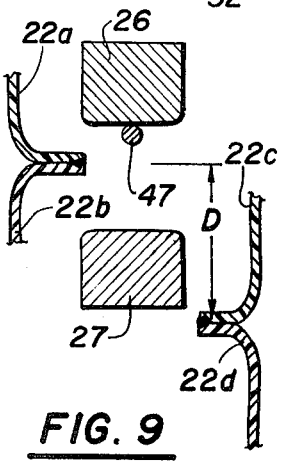
FIG. 9 is a sectional view of the same portion of the machine as FIG. 8, but showing the condition after a sealing, a severing, and a take-up operation have been completed.

Referring to FIG. 8, this shows the condition of the heating and sealing bars 26 and 27 during the sealing operation. Bar 26 is provided with a heating wire 27 which simultaneously heat seals film *22a* to film *22b*, heat seals film *22c* to film *22d*, and severs *22a* from *22c*, and severs *22b* from *22d*. FIG. 9 shows the condition of the apparatus shortly after the sealing operation takes place. The left-hand portions *22a* and *22b* are associated with the wrapped article, while the right-hand parts *22c* and *22d* are also sealed and have been moved downwardly a distance D by the operation of the take-up mechanism 28.

The advantages of the invention will now be readily understood in view of the above description. By having all of the material for wrapping in a given strip originate in a single roll mounted at the top of the frame, it is relatively easy to replace a roll when the material wound on it gets low. An overhead hoist can place the rolls of wrapping material in place and there is no lower roll with its attendant handling difficulties necessary. By using a plurality of rolls with the strips overlapping, it is possible by a suitable selection of numbers of strips to obtain a wrapping that is only slightly larger than the particular article to be packaged. The saving in material is obvious. The present invention also solves a problem presented when one attempts to use less than the total number of strips. Let us assume for purposes of illustration, that in a first wrapping cycle an article is wrapped using all four strips. When the wrapping cycle has been completed the sealing operation in the curtain that remains behind when the wrapped article is removed seals the overlaps or joints between all four strips. In other words, there are three seals that exist at joints. Let us assume then that the next article to be wrapped only requires two strips. The first problem that one encounters is that when the article passes through the bight of the web, the sealing operation takes place right on top of the old seal, which means that the seal may be weakened. In addition, when the short article pushes through and presses against the two strips that are necessary to wrap it, it also acts to pull material down in the third and fourth unnecessary strips because of the fact that it is tied to the other two strips at the overlap seal joints. With the present invention the joint is lowered after each wrapping cycle so that when the next seal takes place, because the joint between the overlap has been lowered, the next joint takes place only between the two remaining strips. In other words, when the article strikes the bight of the two strips that are to be used to wrap it, the third and fourth strips are not pulled down. In other words, no material is used from the third and fourth coils until such time as a larger article is to be wrapped which needs to make use of the material in there strips.

It is clear also, that the use of the "single roll" concept used here, the envelope has only one seam in the longitudinal direction instead of two. This, of course, reduces the probability by 50% of there being a leak in the envelope either due to the original sealing operation, or because of the seam snagging on a nail or the like. One of the major advantages of the multi-strip curtain described above, is that it is not necessary to provide a very wide strip of thermoplastic film to fit a long article. Any length can be made up from strips of smaller width. In other words, most any length of article can be wrapped (including lengths greater than the width of the widest films commercially available) by using multiples of narrow strips of plastic film, but it is still possible to wrap a short article without using an excessive amount of film.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A packaging machine capable of use with elongated articles of varying lengths, comprising:

(a) a frame having an opening through which an article passes laterally from an input side to an output side, (b) means supporting a plurality of rolls of wrapping material on the frame above the opening for independent unrolling, so that strips of material pass downwardly to form a plurality of bights in the opening in side-by-side relationship with a slight overlap between adjacent strips, (c) means for advancing the article through the opening and into the bights of the strips to select automatically from the total number of strips a sub-multiple adequate to enclose the entire length of the article, (d) means mounted on the frame and extending across the opening to form a joint to each other between two portions of the bight of each strip after the article has passed through the opening, the means to form the joint consisting of two opposed heating elements extending longitudinally of the opening on the output side thereof, the lower element and the upper element being relatively movable vertically to engage the strips after the article has passed through the opening, and (e) take-up means to pull the strips downwardly but nonreversably a predetermined small amount after the joint has been formed, the take-up means holding the lower portions of the strips, so that the passage of the article through the opening causes it to engage the bight of the strips and to pull the strips downwardly only from the rolls, the take-up means acting on the material after the sealing operation to move the sealed joint to a position substantially below the level at which the said operation takes place, the take-up means comprising a ratchet mechanism to rotate one of a pair of pinch rolls fixed relative to the frame, the ratchet mechanism operating through an over-running clutch to rotate a roll for the accumulation of material from the lower end of the strips.

2. A packaging machine as recited in claim 1, wherein the passage of the article through the opening causes the strips to wrap partially around the article, while the movement of the heating elements substantially completes the wrapping.

3. A packaging machine as recited in claim 2, wherein the heating elements are provided with a cutting element located centrally of their sealing areas, so that the heating elements seal two layers of the wrapping material together and then sever them, thus leaving a first sealed joint with the portion of the material which is wrapped around the article and leaving a second sealed joint with the portions of the material leading to the rolls and to the take-up means.

4. A packaging machine as recited in claim 1, wherein the take-up means also comprises a pneumatic cylinder, wherein the ratchet mechanism includes a crank arm whose outer end is pivotally connected to the outer end of the piston rod of the cylinder.

5. A packaging machine as recited in claim 4, wherein a control means is provided to energize the take-up means after the sealing and severing operations have taken place.

* * * * *